US005950368A

United States Patent [19]

Bradford

[11] Patent Number: 5,950,368

[45] Date of Patent: Sep. 14, 1999

[54] WATERPROOF PIT COVER

[75] Inventor: Larry Bradford, Costa Mesa, Calif.

[73] Assignee: Dabico, Inc., Costa Mesa, Calif.

[21] Appl. No.: 08/819,479

[22] Filed: Mar. 17, 1997

[51] Int. Cl.[6] ..... E02D 29/14

[52] U.S. Cl. ..... 52/20; 49/379; 49/463; 220/335; 277/642; 277/630

[58] Field of Search ..... 49/463, 465, 466, 49/60, 379, 386; 277/641, 642, 644, 648, 630; 403/381, 322.1, 322.4; 52/19, 20; 220/335, 484; 16/278, 298, 305, 306, 307

[56] References Cited

U.S. PATENT DOCUMENTS

| | | | |
|---|---|---|---|
| 3,945,329 | 3/1976 | Bywater . | |
| 4,467,932 | 8/1984 | Dabich . | |
| 4,468,042 | 8/1984 | Pippert et al. | 277/188 |
| 4,706,718 | 11/1987 | Milo . | |
| 5,335,451 | 8/1994 | Druzynski | 49/379 |
| 5,404,676 | 4/1995 | Devlin . | |
| 5,465,862 | 11/1995 | Devlin . | |
| 5,600,921 | 2/1997 | Vardaro | 49/380 |
| 5,664,793 | 9/1997 | Engibarov | 279/124 |

*Primary Examiner*—Beth Aubrey

*Attorney, Agent, or Firm*—Charles H. Thomas

[57] ABSTRACT

An improved access lid assembly is provided for a subsurface chamber used to service aircraft. A lift assembly is provided for elevating the lid upwardly from an opening in a surrounding mounting frame disposed atop the subsurface chamber while maintaining the lid in a horizontal disposition. A hinge assembly connects the lift assembly to the lid at a peripheral location thereon on the underside of the lid, without any connection to the peripheral edge of the lid. The hinge assembly allows the lid to rotate about a horizontal axis to an open position through an arc of at least ninety degrees. By avoiding any connection to the peripheral edges of the lid, an elastomeric, annular seal can be mounted to completely encircle the lid and provide a water-tight barrier about the access opening. The seal is mounted between the upper and lower surfaces of the lid within a groove, preferably with a dovetail connection, to securely grip and hold the seal upon the edge of the lid. Nevertheless, the use of an adhesive is avoided so that the seal can be easily removed and replaced when necessary. Also, the lift assembly is provided with a damper mechanism so as to protect the lift assembly from impacts and shocks that would otherwise result when the lid falls under the weight of gravity from an opened position to a horizontal disposition atop the access opening.

20 Claims, 6 Drawing Sheets

WATERPROOF PIT COVER

SPECIFICATION

BACKGROUND OF THE INVENTION

1. Field of the Invention

The present invention relates to a lid assembly for an access opening to a subsurface pit for servicing aircraft located beneath an aircraft servicing surface across which aircraft travel while on the ground.

2. Description of the Prior Art

At modern aircraft terminals servicing of aircraft on the ground is frequently performed using prefabricated pits which are installed at aircraft docking, fueling and loading areas. These pits are located beneath the surface of the tarmac across which aircraft travel during docking and departure maneuvers. The pits are typically formed of fiberglass, steel or aluminum and are constructed as enclosures with surrounding walls, and an access lid seated in an opening at the top of the walls. The pits are installed below the surfaces of loading and refueling aprons at aircraft terminals, remote parking locations and at maintenance bases.

The purpose of the pits is to allow ground support functions to be carried out from subsurface enclosures. These ground support functions include the provision of fuel, the provision of electricity to the aircraft while it is in the docking area, the provision of air for cooling the aircraft interior, the provision of pressurized air for starting the aircraft engines, and for other aircraft support activities on the ground. The use of subsurface pits eliminates the need for mobile trucks, carts and other vehicles which are otherwise present in the loading area and which interfere with the arrival and departure of aircraft in the vicinity of a loading gate.

The use of subsurface pits also allows the provision of fuel, power, cooling and pressurized air, and other supplies from a central location. The necessary fluid supplies and electrical power can be generated or stored with a greater efficiency at a central location, as contrasted with mobile generating or supply vehicles.

The pits located below the aircraft terminal area house valves, junction boxes, cooling air terminations and other terminal equipment that is temporarily connected to an aircraft that has been docked. Umbilical pipes and lines, otherwise housed within the pits, are withdrawn from them through hatches therein and are coupled to a docked aircraft to supply it with fuel, air for cooling the aircraft interior, pressurized air for starting the engines, and electrical power.

The pits are constructed with either hinged or totally removable lids that can be moved between open positions allowing access to the pits and closed positions which are flush with the surfaces of the docking, loading or refueling areas across which aircraft travel and beneath which the pits are mounted. Because the pits are located below grade, there is a tendency for water, spilled fuel, dust and debris to fall into the pits through the interstitial cracks surrounding the pit lids within the frames in which the pits are mounted. Since these vertical interstitial gaps represent a point below grade, rainwater and melting snow carries both liquid and solid debris into the gaps surrounding the pit lids. The liquid flows down into the pits carrying some of the debris with it. Also, whenever a pit lid is opened any debris remaining on the shoulder supporting the lid frame is likely to fall into the pit as well.

The entry of dirt, debris and unwanted liquid into the pit enclosure can create problems. Such contaminants accelerate rusting and contribute to jamming of mechanical mechanisms, such as valves and latches. Also, dirt and debris tend to obscure the visibility of dials on pressure and volume gauges, and on dials indicating voltage levels and other readings.

To prevent unwanted contaminants from entering a subsurface pit through the interstitial gaps between the pit lid and the surrounding frame, various sealing systems have been employed. Such conventional sealing systems employ "wiper" seals in which a peripheral seal around a pit lid drags against the surrounding lid mounting frame wall as the lid is seated and unseated relative to the mounting frame. The effect of friction against the mounting frame wall rapidly degrades the integrity of the seal and significantly detracts from the effectiveness of the seal in a relatively short period of time. Thus, conventional pit lid sealing systems have proven unsatisfactory.

Another problem with conventional pit lid sealing systems is that when the seals do degrade they are difficult to replace. Conventional seals are formed of an elastomeric material secured by an adhesive to the edge of the pit lids. When conventional seals become worn and start to leak, they must be pulled away from the lid and the old adhesive must be removed from the edge of the lid before a new replacement seal can be installed. The removal of the old adhesive is a time consuming process, so that worn and deteriorated seals are often not replaced as frequently as they should be.

One prior system which provides a very effective replaceable seal for an aircraft servicing pit lid is described in U.S. Pat. No. 5,404,676. According to this system a pit lid is provided with a flexible, resilient, annular, elastomeric loop which is elastically stretched and removably disposed about the lid to grip it as an encircling jacket. The loop has a plurality of vertically separated, resiliently flexible, radially outwardly extending sealing flaps disposed about its entire perimeter. These flaps are deflected upwardly by contact with the wall of the mounting frame surrounding the access opening so as to establish a liquid-tight seal therewith when the lid is seated in the frame.

While the sealing system of U.S. Pat. No. 5,404,676 is quite effective, certain improvements have been devised. Specifically, in the embodiment disclosed in U.S. Pat. No. 5,404,676 the jacket that extends around and grips the rim of the lid is formed with a generally channel-shaped cross section that includes a pair of upper and lower radially inwardly extending lips. These lips extend over the shoulders of the lid so as to effectuate a grip thereon. While this jacket configuration does provide an effective seal, it is susceptible to damage. For example, in some instances water about the perimeter of the lid that is excluded from entry into the pit will freeze. This prevents removal of the lid until the ice melts or until it is chipped away. In order to free a lid frozen in place in this fashion it is necessary to use some hard implement to strike and chip away at least some of the ice, and then to pry the lid up to break it free from any remaining ice. When this occurs, the elastomeric jacket forming the seal can be damaged.

Some lid assemblies for subsurface pits for servicing aircraft are not hinged to the mounting frame. The access opening to the subsurface pit is exposed by lifting the lid vertically upwardly by means of handgrips cast into the structure of the lid. However, the pit lids are quite heavy and can weigh from fifty pounds to as much as several hundred pounds. Therefore, particularly for larger access openings, the pit lids are hinged to a mounting frame and some type of lift assistance is employed so that the pit lids can be manually raised from a seated, horizontal position. Typically, conventional pit lids of this type are provided with either a counterweight system, such as that described in U.S. Pat. No. 4,467,932, or heavy duty springs to assist in raising the lid. In either case the lid is urged upwardly from the closed position seated in the mounting frame to a fully opened position, preferably through an arc greater than ninety degrees.

Although hinge mechanisms are desirable from the standpoint of raising the lids, they present significant problems to providing water-tight seals. Because the hinge connections of conventional hinged pit lids include hinge-bearing lugs extending radially from the peripheral edge of the lid, it is difficult, if not impossible, to establish a liquid-tight seal along the hinged area of the lid. Moreover, conventional hinge connections to the lid mounting frame often employ bolts that extend through the structure of the frame. These bolt openings form another source of leakage into the pit. As a consequence, rain water, melted snow, dirt, debris, and spilled fuel can all flow into the pit. This leads to corrosion and obstruction of visibility of valves, meters, dials, and the possibility of jammed mechanisms within the pit.

Another problem that arises in conventional sealing systems is that the seal can be damaged when the lid is dropped into position. Since pit lids of this type must be heavy and durable enough to withstand the weight of the tires of a very large aircraft, they must necessarily be heavy and sturdy. Consequently, when the lid descends it frequently does so with a considerable force, even if hinged and counterbalanced by weights or springs. There is thus a significant impact on the elastomeric seal around the edge of the lid. This impact can cause damage to the elastomeric seal.

SUMMARY OF THE INVENTION

A principal object of the present invention is to provide an elastomeric seal that precludes liquid from entering a subsurface pit for servicing aircraft but which is not susceptible to damage when it is necessary to pry the lid free when ice about the periphery of the lid has frozen the lid shut. To this end a closed-loop, elastomeric jacket is still employed, but is configured so that it has no lips that extend above the upper surface or below the lower surface of the lid. Rather, the jacket is formed as an elastomeric band that extends about the peripheral edge of the lid and is releasably engaged therewith by means of a bead and channel connection, which is preferably a dovetail joint.

Specifically, the peripheral edge of the pit lid is preferably formed with a radially inwardly extending dovetail groove having overhanging shoulders extending about the entire perimeter of the pit lid. The annular seal is formed as a band of liquid-impervious, resilient, elastomeric material that has a radially inwardly projecting dovetail bead that can be compressed and forced into the dovetail groove and thereby held securely, but removably, to the edge of the lid.

When the seal is joined to the lid in this fashion it is unnecessary for the edges of the band to grip the top and bottom of the pit lid. Rather, the dovetail joint releasably secures the elastomeric seal to the edge of the pit lid without any contact with the top and bottom surfaces of the pit lid. As a consequence, ice can be chipped from the top of the pit lid and a prybar inserted into the interstitial space between the edge of the lid and the mounting frame without damaging the elastomeric sealing band.

Unlike many conventional lid constructions for hinged lids, a lid assembly according to the present invention can be sealed about its edges by means of an encircling loop or band of elastic material. This band can be stretched during installation so as to elastically contract and grip the edge of the lid throughout its entire perimeter and without contacting the upper and lower surfaces of the lid when it is installed on the lid. This not only eliminates the need for adhesives to attach a seal to the lid, but protects the seal from damage as well. A lid in an improved access lid assembly according to the present invitation can be sealed without adhesives by a surrounding, resilient seal that grips only the edge of the lid, and which can be removed and replaced in only a few moments.

In a preferred construction the edge of the lid is formed with a radially outwardly projecting lip that is located just above the dovetail groove and the annular seal secured therein. Thus, if a prybar is forced down into the interstitial space between the mounting frame and the pit lid, it will strike the protective lip, rather than the softer, more vulnerable seal therebeneath. Preferably also the pit lid is provided with a radially inwardly directed prybar seat located immediately above the protective lip and beneath the upper surface of the pit lid. By providing such a seat a bearing surface is created against which the tip of the prybar can act so as to free the pit lid. Preferably both the protective lip and the prybar seat extend about the entire circumference of the pit lid.

Still another object of the present invention is to provide a hinged pit lid for a subsurface chamber for servicing an aircraft with a hinge arrangement that requires no connection between the peripheral edge of the pit lid and the mounting frame in order to raise the lid in rotation about a horizontal axis. To the contrary, a hinge coupling is provided to the mounting frame at a point on the underside of the lid that is located slightly radially inwardly from the peripheral edge of the lid. Also, a lift assembly is provided which raises the lid vertically a short distance while the lid remains in a horizontal disposition. This ensures that the edge of the lid will clear the mounting frame as the lid is rotated to an open position about a horizontal axis.

By avoiding any direct connection between the edge of the lid and the mounting frame, there is no disruption to the annular dovetail groove that extends about the entire perimeter of the edge of the lid. As a consequence, the sealing band is held in the groove not only by the dovetail joint, but also by the elastomeric action of the sealing band which tends to retain the dovetail bead within the mating groove around the edge of the lid.

A further object of the invention is to provide a pit lid for a subsurface chamber for servicing an aircraft with a cushioning system that cushions the descent of a hinged pit lid as the lid approaches a horizontal disposition preparatory to closure. In preferred embodiments of the invention the cushioning mechanism is formed as a damping shock absorber that is mounted on a spring-loaded lift assembly. As the pit lid is swung shut and approaches a horizontal disposition, it strikes the shock absorber which absorbs a major portion of the impact, and cushions the pit lid as it descends into its fully horizontal position. This serves to minimize damage to the lift assembly. The system is preferably configured so that the point during the arc of descent at which the shock absorber engages the lid can be adjusted.

In one broad aspect the present invention may be considered to be a improvement in an access lid for a subsurface chamber used to service aircraft and having an annular mounting frame defining an access opening therein. The lid is located atop the subsurface chamber and has a peripheral edge defined about its circumference. Like the system of U.S. Pat. No. 5,404,676 a band of a liquid-impervious, resilient, elastomeric material is engaged with the peripheral edge of the lid and forms a seal with the annular mounting frame when the lid is disposed in the access opening in the mounting frame. Unlike this prior system, however, this elastomeric band is releasably engaged to the peripheral edge of the lid by means of a connection therebetween employing an annular groove having lateral retaining walls and a bead that is seated in the groove. The lateral retaining walls constrain relative lateral movement between the seal and the edge of the lid is formed as a dovetail joint therebetween. This dovetail joint preferably extends about the entire circumference of the lid.

In another broad aspect the improvement of the invention may be considered to be the configuration of the peripheral edge of the lid with a radially inwardly directed channel formed into the structure of the edge of the lid so as to extend about its entire circumference. The seal is formed as a resilient, annular, liquid-impervious, elastically distended band, the inner surface of which is formed as a bead removably captured in the channel and having on its outer surface at least one sealing flap that extends outwardly into sealing contact with the frame when the lid is seated in the frame.

In still another broad aspect the invention may be considered to be an improvement in an access lid assembly having a lid of rigid construction throughout that is able to withstand the weight applied by the tires of an aircraft traveling thereacross, an annular mounting frame located atop a subsurface chamber used to service aircraft and defining an opening therewithin in which the lid is seatable in a horizontal seated disposition, and a lift assembly for elevating the lid upwardly from the opening while maintaining it in a horizontal disposition.

According to the improvement of the invention a hinge assembly is provided that defines a horizontal axis and joins the lid at a peripheral location thereon on the underside thereof to the lift assembly for rotation about the horizontal axis to an open position through an arc of at least ninety degrees. By being connected to the lid at its underside, rather than at its edge, the hinge assembly avoids any connection to the edge of the lid so that an annular, elastomeric seal can extend unbroken and uninterrupted about the entire perimeter of the edge of the lid. Preferably, also a damper mechanism is located on the lift assembly to cushion the lid as it moves from its open to its seated position.

One important feature of the improvement of the invention resides in the provision of a lid lifting assembly located in the subsurface chamber and secured relative to the mounting frame and attached to the underside of the lid near the periphery thereof, but not to the edge of the lid. The lid lifting assembly is able to carry the lid in translational movement between a seated position in which the lid is supported by the mounting frame, and a raised position in which the underside of the lid is elevated above the mounting frame. The invention also employs a rotatable coupling interposed between the lid lifting assembly and a location on the underside of the lid and near its periphery to permit rotational movement of the lid about a horizontal axis relative to the lid lifting assembly. The lid is thereby swung open when it is in a raised position slightly above the access opening. The invention thereby provides a system for not only elevating an aircraft servicing pit lid from a seated to a raised position, but also a means for moving the pit lid in angular rotation about a horizontal axis out of vertical alignment with the access opening so as to facilitate access to the pit.

Using the improved access lid assembly of the invention, the lid is raised from a position in which the periphery of its undersurface is seated on a bearing ledge defined on the mounting frame and in which its top surface is flush or level with the aircraft servicing surface beneath which the subsurface chamber is installed. The lid lifting assembly and the hinge mechanism are both located and mounted entirely within the subsurface chamber so that they are not subject to deformation by forces applied from above. Therefore, neither the lift assembly nor the hinge mechanism can be damaged by vehicular traffic or heavy equipment that may impact upon the lid.

Preferably, the lid lift assembly of the invention is comprised of a parallelogram linkage arrangement that includes a vertically upright base member secured in the subsurface chamber relative to the mounting frame, upright lid supports that are oriented parallel to the base member, and parallel upper and lower link arms of equal length connected at rotatable connections to the base member and to the upright lid supports. The ends of the upper and lower link arms are vertically spaced a uniform distance apart and are located beneath the undersurface of the lid. Operation of the parallelogram linkage carries the pit lid in translational movement, so that it remains in a horizontal disposition throughout its path of travel between its seated and raised positions. The lid lift assembly employs some type of elevation assisting means, preferably one or more stainless steel springs, for urging the lid from its seated to its raised position with a force no greater than the weight of the lid.

Another advantage of the invention is that because there is no hinge mechanism exposed atop the lid mounting frame, the susceptibility of leakage at a surface hinge location is eliminated. There are no through holes or bolt openings through the top of the lid mounting frame through which liquid can leak. Moreover, the peripheral edge of the lid is not interrupted by the hinge mechanism, but is smooth and unbroken about its entire perimeter. As a consequence, a fluid tight seal can be mounted about the entire periphery of the lid.

The access lid assembly of the invention is designed so that existing subsurface pits can be retrofitted with the device. Thus, when lids having hinge mechanisms that are exposed to damage from external forces operate defectively, they can be replaced with the access lid assembly of the invention within existing pits.

The access lid assembly has an additional advantage in that there is a no above grade protrusion. No portion of the hinge mechanism is located above the undersurface of the lid itself, much less above the surface beneath which the pit is installed. When the lid is in the fully seated position, it is flush with the surrounding surface.

The invention may be described with greater clarity and particularity by reference to the accompanying drawings.

DESCRIPTION OF THE EMBODIMENT

Figure 1:
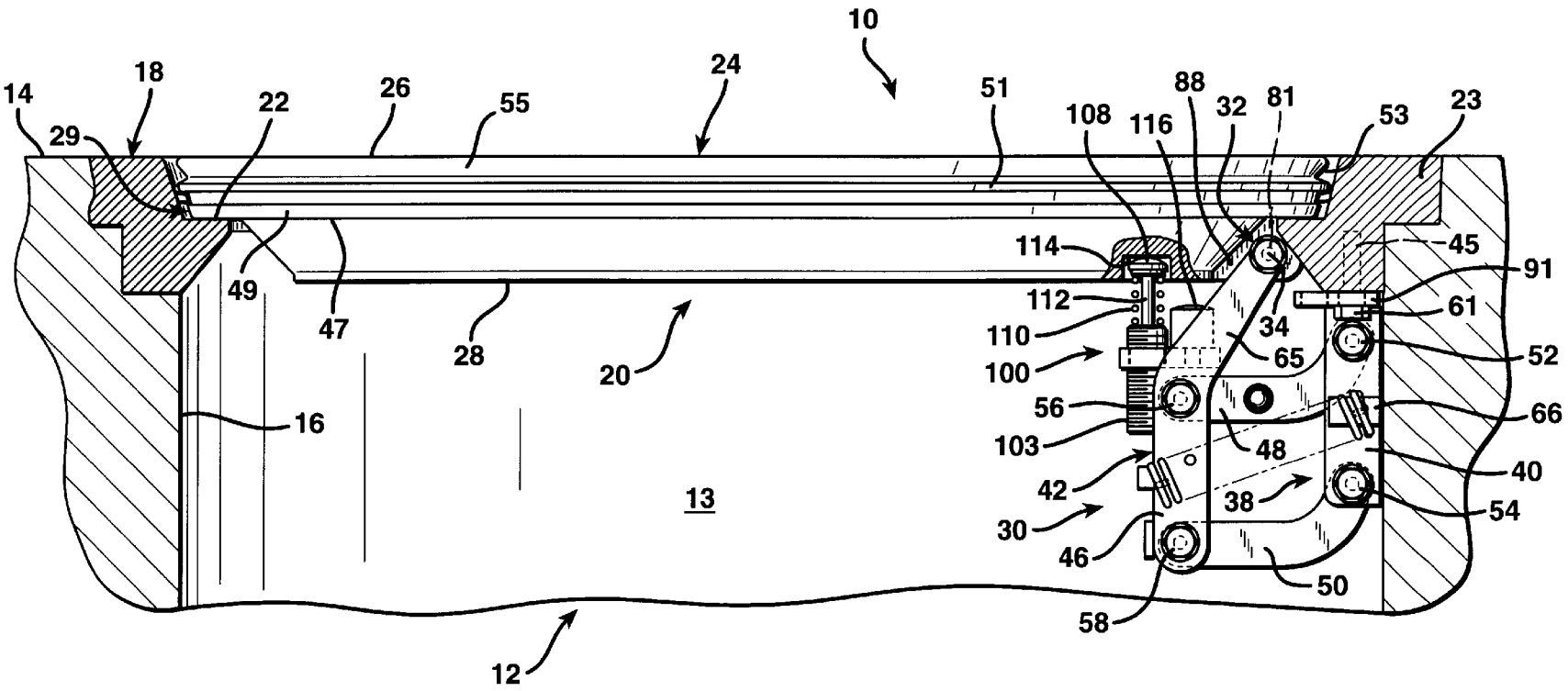
FIG. 1 is a sectional elevational view showing the upper portion of a pit for servicing aircraft with the lid thereof shown in a closed, horizontal disposition.
Figure 2:
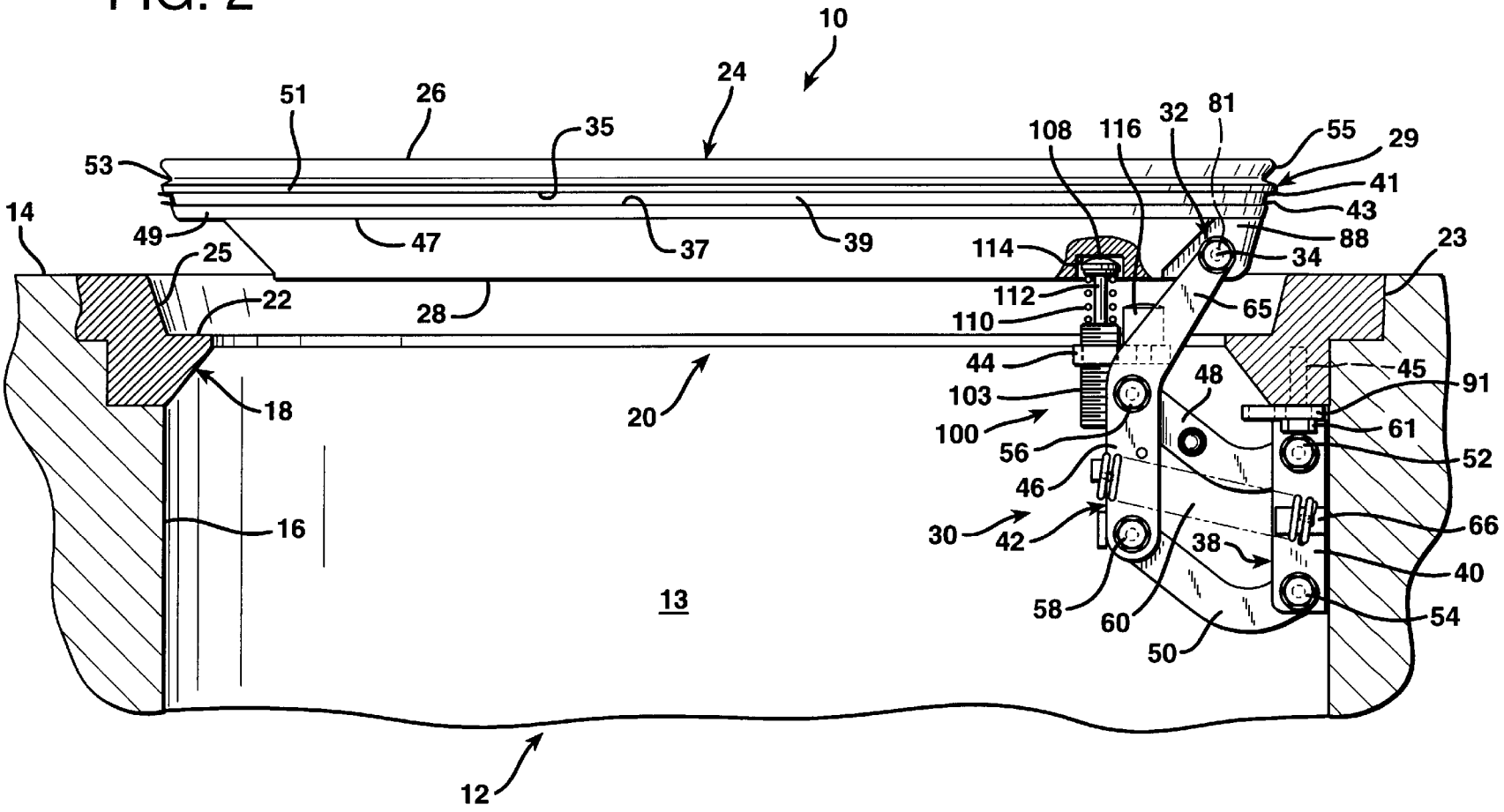
FIG. 2 illustrates the system of FIG. 1 in which the lift assembly has elevated the lid to a raised position to clear the mounting frame in preparation for opening the lid.
Figure 3:
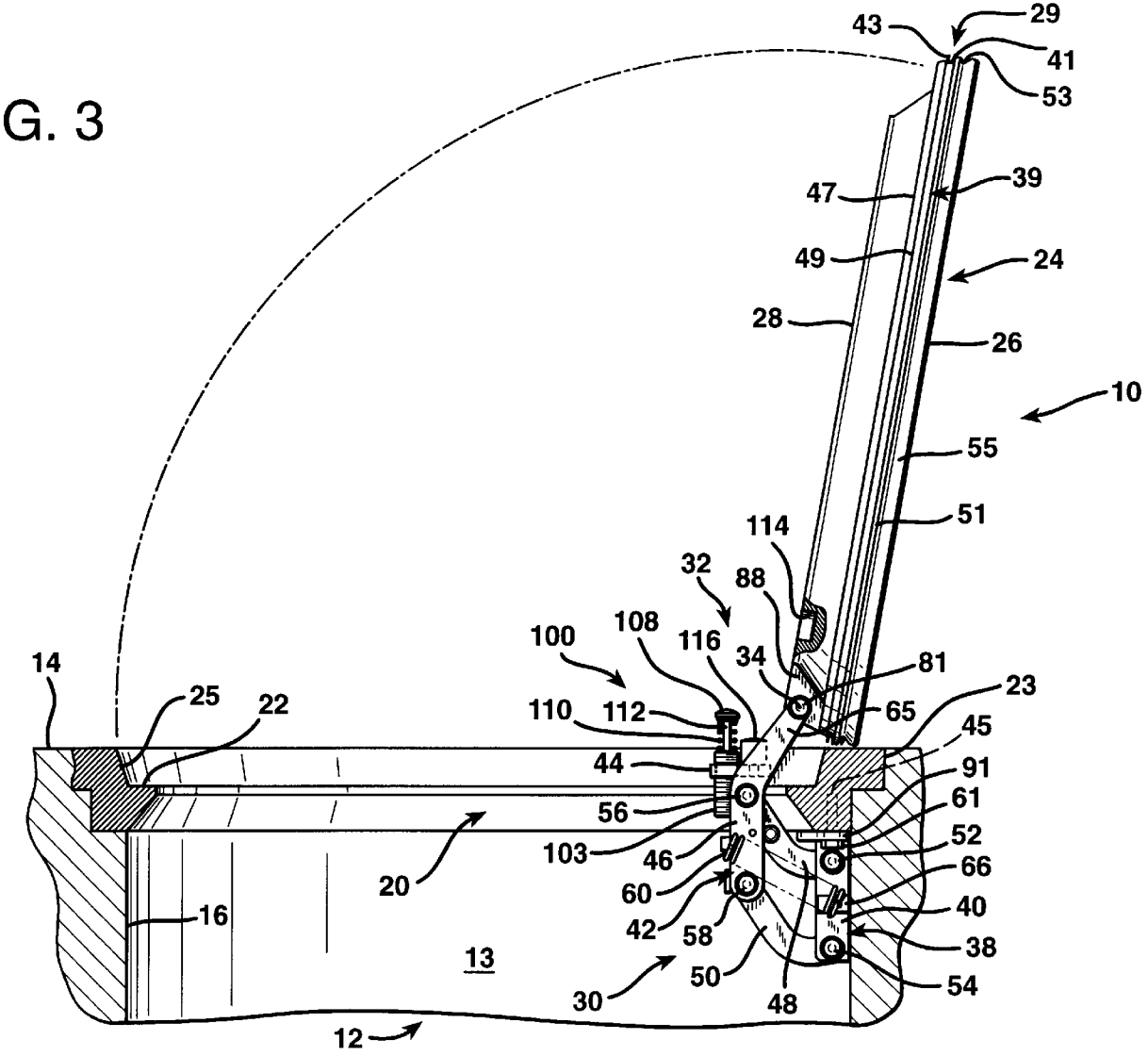
FIG. 3 illustrates the pit lid of the invention moved toward its open position.

FIGS. 1–3 show an access lid assembly indicated generally at 10 for a pit 12 for servicing an aircraft. The pit 12 is located beneath an aircraft servicing surface 14 across which aircraft travel while on the ground. The pit 12 has an annular lid mounting frame 18 at its top. The mounting frame 18 defines a circular access opening 20 to the pit 12 within the frame 18. The mounting frame 18 includes an annular, horizontal bearing ledge 22 surrounding the access opening 20.

The pit 12 may be of either a rectangular or a cylindrical configuration, and in any event has one or more upright walls 16 which may be formed of resin-impregnated fiberglass to enclose a subsurface chamber 13. The lid mounting frame 18 is normally constructed of either steel or aluminum, and has a radially outwardly directed flange 23 that is normally at the level of the surrounding aircraft servicing surface 14. The bearing ledge 22 is located radially inwardly from the surface flange 23 of the lid mounting frame 18, and recessed beneath the level of the surface 14. A frustoconical wall extends between the surface flange 23 and the bearing ledge 22 of the mounting frame 18.

The access lid assembly 10 is comprised of a lid 24 strong enough to withstand the weight of the tires of an aircraft traveling thereacross. The lid 24 is provided to cover the access opening 20 when in its closed position shown in FIG. 1. The lid 24 has an upper surface 26, an undersurface 28, and a radially outwardly facing peripheral edge 29 located therebetween.

Figure 4:
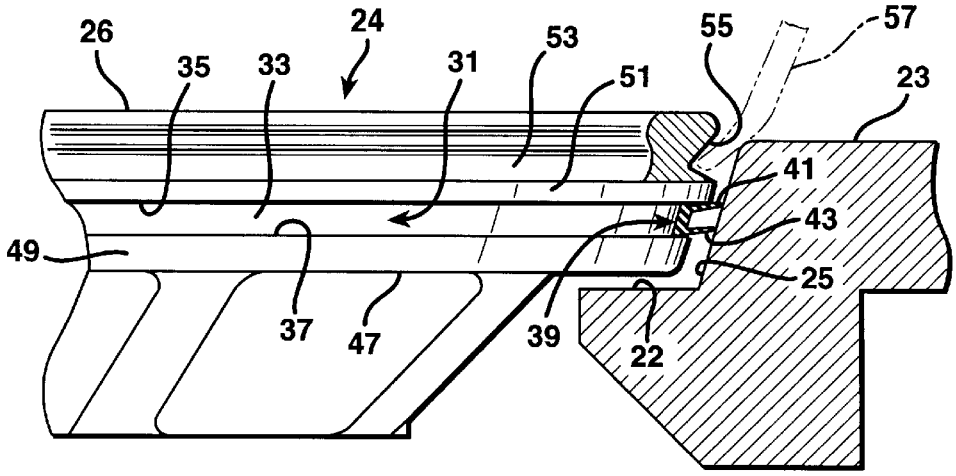
FIG. 4 is an elevational detail of FIG. 1, partially broken away, illustrating the improved lid sealing system of the invention.
Figure 7:
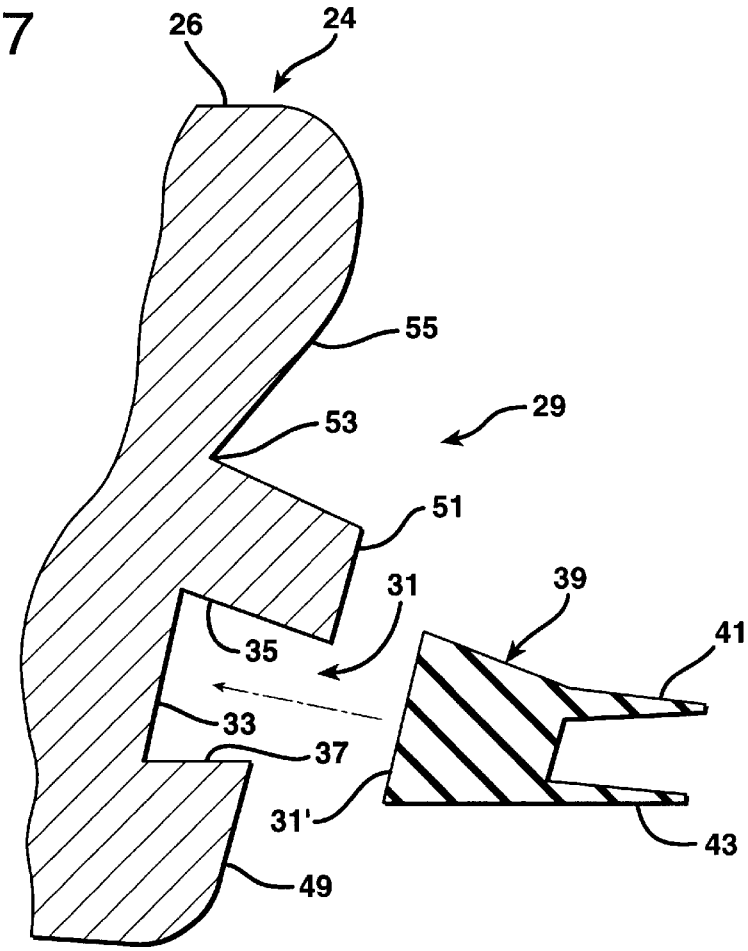
FIG. 7 is a sectional detail diagram illustrating the dovetail components in the connection of the seal to the edge of the lid.

As best illustrated in FIGS. 4 and 7 an annular, radially inwardly directed groove or channel 31 is defined in the peripheral edge 29 of the lid 24. The channel 31 is formed with a floor 33, an upper seal-retaining wall 35, and a lower seal-retaining wall 37.

The lid 24 is provided with a seal 39 formed as a band of a liquid-impervious, resilient, elastomeric material, such as Buna-N rubber. The seal 39 is configured as an endless loop that is stretched to pass over the upper portion of the lid 24 and is seated in the channel 31, as shown in FIG. 4. The seal 39 is elastomerically stretched to surround and grip the peripheral lid edge 29. Because the seal 39 is elastically distended and seated in the groove 31 it is held in position gripping the floor 33 of the channel 31 by the force of elasticity tending to contract the diameter of the seal 39. The seal 39 is laterally constrained and held in the channel 31 by the retaining walls 35 and 37. The elastic distension of the seal 39 and the laterally confining structure formed by the retaining walls 35 and 37 ensure that the seal 39 remains in position gripping the edge 29 without employing an adhesive.

When the seal 39 ultimately becomes worn or damaged, it can be replaced very easily. For removal, the seal 39 is merely stretched so that it can be pulled out of the groove 31, past the retaining wall 35, and off of the lid 24 over the top surface 26 thereof. A replacement seal 39 is then installed in the reverse manner. As no adhesive is required to secure the seal 39 to the pit lid 24, replacement of the seal 39 can be performed in only a matter of seconds.

The annular seal 39 has a pair of annular flaps 41 and 43 that extend radially from the band forming the seal 39. As illustrated in FIG. 4, the flaps 41 and 43 are deflected resiliently upwardly to form a seal against the frustoconical wall 25 of the mounting frame 18 about the entire perimeter of the lid 24 when the lid 24 is fully seated in the mounting frame 18 as depicted in FIGS. 1 and 4. The frustoconical wall 25 has a taper of about fifteen degrees relative to vertical or about seventy-five degrees relative to the horizontal bearing ledge 22 of the mounting frame 18. This taper or incline is sufficient to allow the flaps 41 and 43 to be deflected resiliently upwardly, rather than slide along the mounting wall surface 25. The flaps 41 and 43 extend from the peripheral edge 29 of the lid 24 a distance that they first contact the frustoconical wall 25 only when the lid 24 has been lowered to within one-quarter of an inch of its fully seated position, illustrated in FIG. 1.

The pit lid 24 may be constructed of steel, or aluminum, for example, and is of a generally disc-shaped configuration. In the embodiment illustrated, the pit lid 24 may weigh fifty pounds. The lid 24 has an outer, peripheral, annular margin 47 on its underside which is larger in outer diameter than the inner diameter of the lid mounting frame bearing ledge 22. The peripheral margin 47 of the lid 24 thereby rests atop and bears downwardly against the annular bearing ledge 22 when the lid 24 is in the seated position illustrated in FIG. 1. In this manner the mounting frame 18 supports the lid 24 from beneath about its entire outer perimeter.

The structure of the lid 24 immediately above the margin 47 forms a radially outwardly directed, annular bearing ring 49, the outer diameter of which is greater than the diameter of the floor 33 of the groove or channel 31. Typically, the outer surface of the bearing ring 49 is at least about one-half inch greater than the diameter of the floor 33 of the channel 31. In the position depicted in FIG. 1, the underside of the bearing ring 49 rests on the mounting frame bearing ledge 22. The upper surface 26 of the lid 24 is at the level of the aircraft servicing surface 14.

Above the channel 31 the structure of the lid 24 is formed with another radially outwardly projecting, ring-like protrusion 51 that serves as a radially outwardly projecting protective lip located just above the groove 31. The protective lip is bounded on its lower side by the upper channel wall 35. On its opposite side the protective lip 51 is formed with a radially inwardly directed, annular depression 53 that serves as a prybar seat. The prybar seat 53 is located immediately above the protective lip 51. The structure of the lid 24 is flared outwardly above the depression 53 so as to provide a bearing surface 55 against which the toe of a prybar lever 57 can bear in order to pry the lid 24 free from the mounting frame 18, should it become frozen thereto by ice. It should be noted in FIG. 4 that the protective lip 51 is configured so that when a prybar 57 is inserted into the interstitial space between the frustoconical wall 25 of the mounting frame 18 and the peripheral edge 29 of the lid 24, it stops the prybar 57 before it reaches the seal 39, and thereby protects the seal 39 from damage.

While the groove or channel 31 can be formed by a milling operation utilizing a disk-shaped milling tool so that the side walls 35 and 37 of the channel 31 intersect the floor 33 thereof at right angles, preferably the channel 31 is formed as a true dovetail groove, as best illustrated in FIG. 7. In the preferred embodiment of the invention the upper side wall 35 is undercut relative to the protective lip 51 and forms an angle of seventy-five degrees relative to the channel floor 33. Likewise, the lower retaining wall 37 also forms an undercut relative to the bearing ring 49 and intersects the floor 33 at an angle of sixty-five degrees. The radially interior bead portion 31' of the sealing band 39 has the same configuration as the channel 31, so that it is necessary to compress the bead 31' formed by the inner portion of the seal 39 so that it will pass between the overhanging shoulders formed by the retaining walls 35 and 37 with the protective lip 51 and bearing ring 49, respectively. The seal 39 is thereby held in position not only by its elastic distension, but also by the positive grip between the sides of the bead 31' of the seal 39 and the overhanging retaining walls 35 and 37 of the groove 31.

The access lid assembly 10 also includes a lift assembly indicated generally at 30. The lift assembly 30 is located in the subsurface chamber 13 adjacent the wall 16 and is secured to the underside of the mounting rim 18 by means of studs 45 depending therefrom and washers 63 and lock nuts 61 engaged on the downwardly protruding tips of the studs 45. The lift assembly 30 is operable to move the lid 24 in translation from a closed position seated in the mounting rim 18, as shown in FIG. 1, to an elevated position in which the lid 24 clears the mounting frame 18, as shown in FIG. 2.

The lift assembly 30 is formed of a base member 38 that may be constructed from hollow, square tubular steel stock. The side walls 40 of the base member 38 are oriented parallel to each other and are located generally radially inwardly from and adjacent to the wall 16 of the subsurface chamber 13.

At the top of the base member 38 there is a horizontally disposed, generally U-shaped attachment plate 91 welded to the upper extremities of the base member side walls 40. The plate 91 has elongated slots 59 defined therethrough. The slots 59 extend parallel to the base member side walls 40 in generally radial alignment relative to the pit access opening 20.

By loosening the nuts 61 the base member 38 can be moved slightly toward or away from the pit access opening 20 to thereby shift the entire lift assembly 30 within the limits of movement allowed by the slots 59. In this way the location of the lift assembly 30 can be adjusted relative to the access opening 20 so that the lid 24 can be placed precisely centered within the access opening 20. Once properly aligned relative to the opening 20, the tubular-shaped base member 38 is securely attached to the underside of the lid mounting frame 18. The plate 91 is secured to the studs 45 threaded into and depending from tapped vertical bores in the underside of the lid mounting frame 18 by means of the washers 63 and the locking nuts 61.

The lift assembly 30 also has an upright lid support member 42 formed with a horizontally disposed damper mounting platform 44 and a pair of flat, upright legs 46 located on either side thereof. The lower portions of the legs 46 extend vertically downwardly, while the upper portions thereof form lid mounting arms 65 that extend upwardly and outwardly on either side of the lid hinge mounting lug 88. The lower portions of the legs 46 are oriented parallel to the side walls 40 of the base member 38 in generally coplanar relationship relative thereto. The lid support 42 includes a vertically oriented connecting web 67 extending between and stabilizing the lower portions of the legs 46.

The lift assembly 30 also includes a pair of solid link arms 48 and 50 which are of generally L-shaped configuration and which are equal in size. The link arms 48 and 50 are connected to side walls 40 of the base member 38 and to the legs 46 of the upright lid support 42 at rotatable connections 52 and 54 on the base member 38 and at rotatable connections 56 and 58 on the lid support member 42. The rotatable connections 52 and 54 are spaced apart vertically the same distance that the rotatable connections 56 and 58 are spaced apart. The rotatable connections 52, 54, 56, and 58 may take the form of hexhead bolts 69 that extend through sleeve-like bushings 71. These are secured by lock nuts 73 and washers 75.

Figure 5:
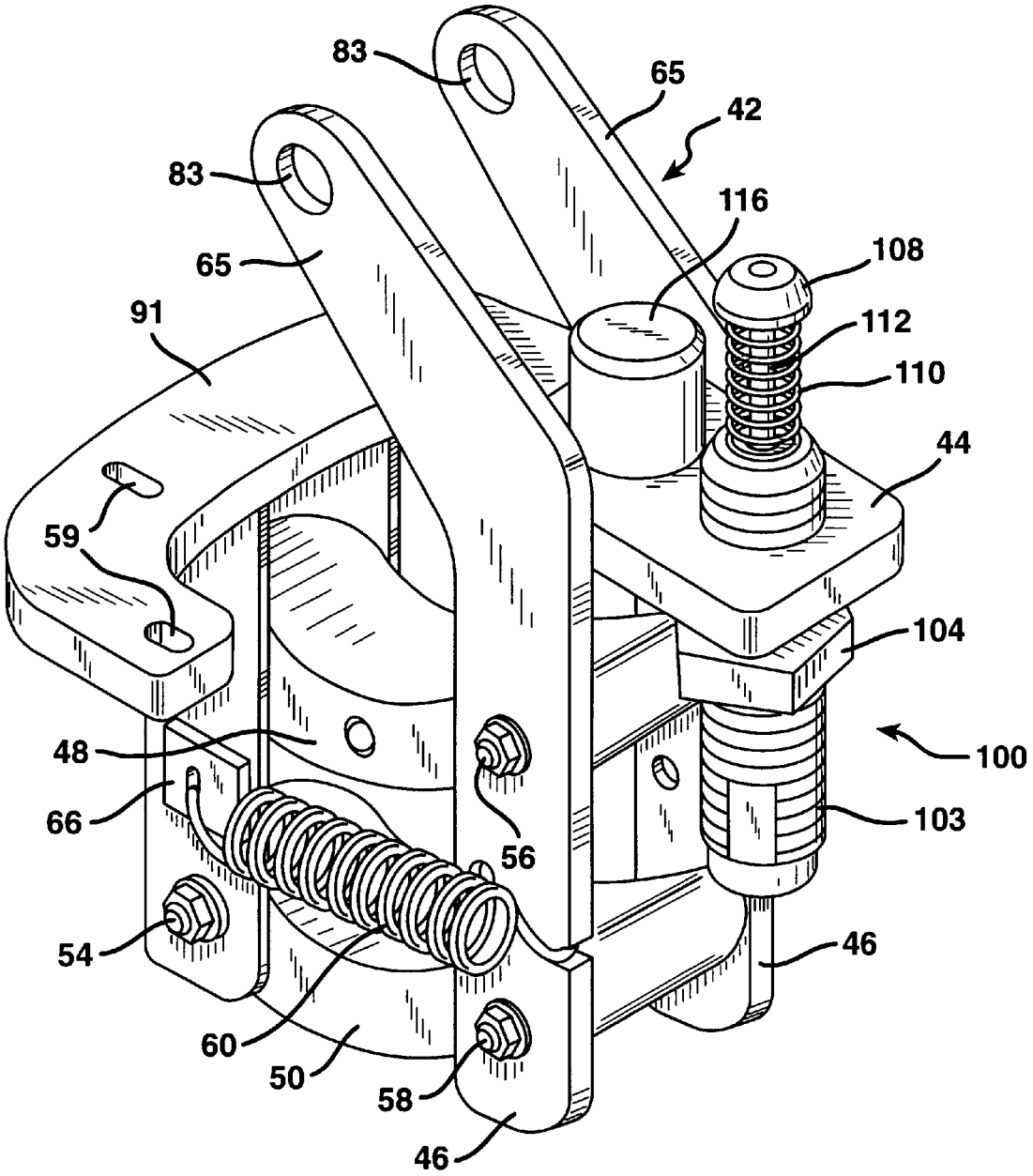
FIG. 5 is a perspective view of the lift assembly employed in the system of FIGS. 1–3.

The lift assembly 30 also includes a pair of stretched, stainless steel coil springs 60, best illustrated in FIG. 5. The springs 60 are located outboard from the legs 46 of the lid support member 42. The outer ends of the coil springs 60 are hooked through transverse openings defined through reinforcing plates 66 that are welded to the base member side walls 40. The reinforcing plates 66 are located a short distance above the vertical level of the connections 54. The opposite ends of the coil springs 60 are hooked about the legs 46 at spring mounting grooves 79 defined therein.

As illustrated in FIGS. 1–3, when the lid 24 resides in the horizontal, seated disposition illustrated in FIG. 1 covering the opening 20, the force applied by the coil springs 60 acts at only a slight distance or moment arm from the rotatable connections 54. This is sufficient to offset a portion of the weight of the lid 24, however. When the lid 24 is seated as shown in FIG. 1, the springs 60 urge the lid 24 from its seated position of FIG. 1 toward the elevated position of FIG. 2 with a force less than the weight of the lid. Preferably, this spring force counteracts approximately twenty pounds of the weight of the lid 24, in the embodiment illustrated, resulting in an initial force of thirty pounds required to lift the peripheral margin of the lid 24 from the bearing ledge 22 of the mounting frame 18.

As the lid 24 is lifted from the position of FIG. 1 toward the position of FIG. 2 by an upward force applied manually against the inclined bearing surface 55, the moment arm of the coil springs 60 relative to the rotatable connections 54 increases as the rotatable connections 58 are lifted upwardly. Once the lid 24 has passed approximately half way through its path of travel from the seated position of FIG. 1 to the raised position of FIG. 2, the increased angle of the springs 60 relative to the link arms 50 causes the springs 60 to exert an even greater pull on the lifting linkage of the lift assembly 30. The springs 60 are oriented so that as the lid 24 is lifted to the elevated position of FIG. 2, they apply a greater moment to the link arms 50 tending to raise the lid 24. As a consequence, the springs 60 provide a continually increasing lifting force to the lid 24 while the lid 24 is lifted toward the raised position depicted in FIG. 2 as compared to the force initially required to lift the lid 24 from the seated position depicted in FIG. 1. As a result, less and less manual force is required to continuing lifting the lid 24 as it moves away from the seated position of FIG. 1.

As the lid 24 reaches the elevated position of FIG. 2, the orientation of the springs 60 is such that the springs 60 act with a force at least as great as the weight of the lid 24 to hold the lid 24 in the elevated position of FIG. 2, absent some external downward force. When the lid 24 reaches the elevated position of FIG. 2, the springs 60 hold the lid 24 in this elevated position and overcome the opposing rotational moment exerted on the parallelogram linkage of lift assembly 30 by the gravitational force due to the weight of the lid 24. As the lid 24 is moved from the seated position of FIG. 1 to the elevated position of FIG. 2, the parallelogram linkage of the lift assembly 30 maintains the lid 24 in a horizontal disposition.

The access lid assembly 10 also includes a hinge assembly 32 formed of a horizontal hinge axle bolt 81, the shank of which is aligned along a horizontal axis 34. The hinge axle bolt 81 projects through a lid hinge mounting lug 88 that is located near the periphery of the lid 24 beneath the bearing ring 49. The hinge assembly 32 connects the lid 24 to the lift assembly 30 for rotation relative thereto about the horizontal axis of rotation 34 between a horizontal disposition depicted in FIG. 2, through an arc of at least ninety degrees, and preferably greater, to an open position as depicted in FIG. 3. In this way the lid 24 is rotatable about the horizontal axis 34 to expose the access opening 20 when in the open position, as shown in FIG. 3.

Figure 6:
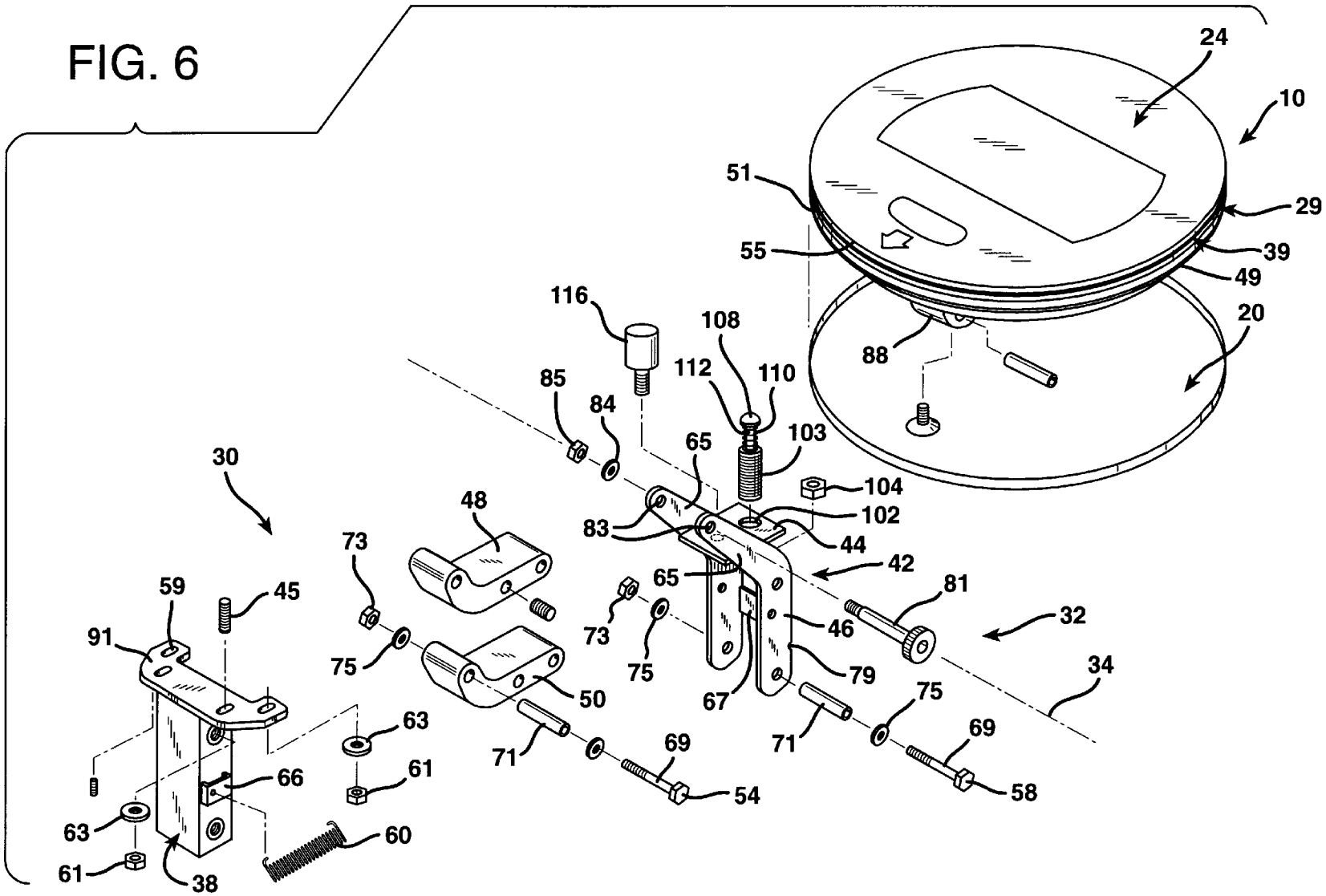
FIG. 6 is an exploded, perspective view illustrating the lift assembly and the hinge assembly of the improved subsurface aircraft servicing pit of the invention.

The hinge assembly 32 is illustrated in detail in the exploded view of FIG. 6. The hinge axle bolt 81 is a shoulder bolt that passes through a pair of openings 83 at the upper extremities of the lid mounting arms 65 and through the lid hinge mounting lug 88 on the underside of the lid 24 that is embraced between the lid hinge mounting arms 65. The shank of the bolt 81 passes through a bronze bushing that 20 resides within the transverse bore defined through the structure of the lid hinge mounting lug 88 to permit free rotational movement of the lid 24. The bolt 81 is secured to the mounting arms 65 by means of a washer 84 and a lock nut 85. The lid 24 is thereby rotatable about the horizontal axis of rotation 34 defined by the shank of the shoulder bolt 81 from the horizontal disposition in which it resides in its elevated position shown in FIG. 2 to its fully open position shown in FIG. 3.

The lid 24 preferably is rotated through an arc of about one hundred twenty degrees in moving from the position of FIG. 2 to the open position shown in FIG. 3. It should be noted that as the lid 24 is rotated about the horizontal axis 34, there is no interference between the peripheral edge 29 of the lid 24 and the mounting frame 18.

The lid assembly 10 is equipped with a damper mechanism 100 located on the lift assembly 30. The damper mechanism 100 cushions the lid 24 as it moves from the open position of FIG. 3 to its horizontal, elevated position depicted in FIG. 2. The damper mechanism 100 thereby absorbs some of the impact that would otherwise act upon the lift assembly 30 as the lid 24 rotates downwardly about the horizontal axis 34 under the force of gravity to the position shown in FIG. 2.

The damper mechanism 100 is a vertically oriented shock absorber mounted on the lift assembly 30 in lateral displacement from the horizontal axis 34 so as to cushion the lid 24 in moving from its open position of FIG. 3 to a horizontal disposition depicted in FIG. 2. The damper mounting platform 44 that is disposed between the parallelogram arms 46 includes a bore 102 defined therethrough. The bore 102 is a vertically aligned, internally threaded, tapped opening in the damper platform 44.

The shock absorber 100 is a hydraulic damper having an externally threaded barrel 103 that is screwed into the threaded opening 102 to a selected elevation relative to the damper mounting platform 44. A lock nut 104 is threadably engaged on the externally threaded barrel 103 of the shock absorber 100 and is used to lock the shock absorber in a selected position of elevation relative to the lift assembly 30 so as to intercept the lid 24 at a selected position in its arcuate movement toward a horizontal disposition. The shock absorber 100 has a pad 108 on its upper end and employs a piston rod 110 that extends downwardly from the pad 108 to a piston in the barrel 103 of the shock absorber 100. The piston rod 110 is biased upwardly by means of a coil spring 112 interposed between the pad 108 and the barrel 103.

The barrel 103 forms the cylinder of the shock absorber mechanism 100 and is mounted in an upright, vertical disposition. The length of the portion of the barrel 103 that is advanced through the threaded opening 102 and which projects above the level of the damper mounting platform 44 determines the point at which the underside 28 of the lid 24 strikes the pad 108. This varies the cushioning effect of the damper mechanism 100 on the lid 24. The greater the height to which the barrel 103 of the shock absorber 100 protrudes above the mounting platform 44, the earlier will be the point of engagement of the shock absorber mechanism 100 during the arcuate movement of the lid 24 in returning from the open position of FIG. 3 to the horizontal disposition of FIG. 2.

The piston at the lower end of the piston rod shaft 110 moves reciprocally within the cylinder defined within the barrel 103. The piston rod shaft 110 extends vertically upwardly from the cylinder barrel 103 with the pad 108 located thereatop. The biasing spring 112 urges the piston upwardly within the confines of the barrel 103 forming the hydraulic cylinder. As illustrated in FIGS. 1–4, a disk-shaped cavity or pocket 114 is preferably defined in the underside 28 of the lid 24 so as to receive the pad 108 therewithin when the lid 24 is moved from the open position of FIG. 3 to the horizontal disposition shown in FIGS. 1 and 2.

By employing a shock absorber or damper mechanism 100, strain on the lift assembly 30 is minimized due to closure of the lid 24. The use of the damper mechanism 100 thus greatly prolongs the useful life of the lid assembly 10. A urethane bumper 116 having a steel stud depending therefrom is screwed into another opening in the damper mounting platform 44 as a further means for reducing impact on the lift mechanism.

As the lid 24 is pushed shut from the raised, elevated position of FIG. 2 to the closed, seated position of FIG. 1, the moment exerted by the springs 60 tending to raise the lid decreases, due to the decreased moment arm with which the springs 60 act upon the link arms 50. Thus, when the lid 24 is reseated as illustrated in FIG. 1, the assisting force of the springs 60 tending to raise the lid 24 is substantially less than the gravitational force of the weight of the lid, so that the lid remains seated and cannot pop open of its own accord.

A lid assembly 10 constructed according to the present invention has significant advantages over prior lid closure systems for sealing subsurface chambers housing equipment for servicing aircraft. By providing an elastically distended seal confined to a location set within the peripheral edge of the lid, rather than extending to the upper and lower surfaces thereof, the seal is easier to protect from damage. By providing a protective lip above the channel in which the seal is set, ice that may have frozen in the interstitial space between the lid and the mounting frame can be chipped away with a hard implement to free the lid from the mounting frame without danger of damage to the seal. Furthermore, by providing a prybar seat above the protective lip, a prybar can be inserted into the gap between the edge of the lid and the surrounding mounting frame so as to pry the lid free from ice that may have collected and which can otherwise hold the lid frozen shut.

By providing a lift mechanism that involves no connection to the peripheral edge of the lid, and by providing the edge of the lid with a channel that seats a seal formed as a stretched, annular, resilient, elastomeric band, the difficulty of sealing a hinged lid throughout its perimeter is obviated. Furthermore, by providing the lift assembly with a damping system such as a shock absorber, the danger of damage to the lift assembly due to impact from the lid swinging down from an open position to a horizontally disposed position is minimized.

Undoubtedly, numerous variations and modifications of the invention will become readily apparent to those familiar with subsurface pits utilized for servicing aircraft. For example, the seal mounting system could employ a radially projecting annular bead or ring on the edge of the pit lid, and a seal with a radially inwardly facing channel defined therein to receive the bead. In such an arrangement the channel would be defined in the seal and the bead would be formed on the edge of the lid, rather than the reverse mounting arrangement depicted in the embodiment illustrated in the application drawings. Other variations and modifications are also possible. Accordingly, the scope of the invention should not be construed as limited to the specific embodiment depicted and described.

I claim:

1. In a rigid access lid for a subsurface chamber used to service aircraft and having an annular mounting frame defining an access opening therein and located atop said subsurface chamber wherein said lid has a peripheral edge defined about its circumference and comprising an annular seal formed as a band of a liquid-impervious, resilient, elastomeric material removably engaged with said peripheral edge of said lid and forming a seal with said annular mounting frame when said lid is disposed in said access opening therein, the improvement wherein said band is elastically distended and releasably engaged to said peripheral edge by means of an interlocking connection therebetween that extends about the entire perimeter of said peripheral edge and employing an annular groove in the peripheral edge having a floor that is exposed radially throughout the circumference of said peripheral edge and having lateral retaining walls extending outwardly from said floor and which are shaped to provide shoulders overhanging said floor, and said band including a bead having a radially interior portion that has the same configuration as said shoulders of said groove and which is compressible so as to pass between said shoulders to allow said bead to be removably seated in said groove and said lateral retaining walls constrain relative lateral movement between said bead and said groove.

2. A lid according to claim 1 wherein said groove is a radially inwardly directed dovetail groove formed in said peripheral edge of said lid, and said bead is a compressible, radially inwardly projecting dovetail bead that is held by said dovetail groove to releasably fasten said seal to said peripheral edge of said lid.

3. A lid according to claim 2 wherein said peripheral edge of said lid is formed with an annular, radially outwardly projecting protective lip located above and projecting radially outwardly beyond said dovetail groove, and a radially inwardly directed prybar seat located above said protective lip.

4. A lid according to claim 1 wherein said band has at least one radially outwardly projecting sealing flap extending therefrom which is deflected upwardly by contact with said mounting frame to form said seal therewith when said lid is disposed in said access opening.

5. A lid according to claim 4 comprising a pair of said sealing flaps.

6. In a pit for servicing aircraft located below a surface across which aircraft travel and having an access opening frame located at said surface and a lid capable of withstanding the weight from the tires of an aircraft traveling thereacross removably seatable in said frame, the improvement wherein said lid has a peripheral edge into which a radially inwardly directed channel is formed to extend about the entire circumference of said lid, and wherein said channel is formed with a floor that is exposed radially throughout the entire circumference of said lid and with lateral side walls extending outwardly from said floor and which are shaped to provide shoulders overhanging said floor, a seal formed as a resilient, annular liquid-impervious, elastically distended band formed as a bead and including a radially interior portion that conforms to the configuration of said channel and which is compressible so as to pass between said shoulders to allow said band to be removably captured in said channel by interlocking engagement with said shoulders and an outer surface of said band has at least one sealing flap that extends outwardly and into sealing contact with said frame when said lid is seated in said frame.

7. A pit according to claim 6 wherein said channel and said bead are interlocked to form a dovetail connection, and said lid is provided with a radially outwardly projecting lip to shield said seal from above, and a radially inwardly extending prybar seat located above said lip.

8. A pit according to claim 6 further comprising a lift assembly secured relative to said frame and coupled to said lid and operable to lift said lid vertically upwardly above and clear of said frame, and a hinge assembly connecting said lid to said lift assembly for rotating said lid relative to said lift assembly about a horizontal axis of rotation between a horizontal disposition through an arc of at least ninety degrees to an open position.

9. A pit according to claim 8 further comprising a damper mechanism secured to said lift assembly in lateral displacement from said horizontal axis of rotation to cushion movement of said lid from said open position to said horizontal disposition.

10. A pit according to claim 9 wherein said damper mechanism is comprised of a cylinder mounted in an upright vertical disposition, a piston mounted for reciprocal movement within said cylinder and having a shaft extending vertically upwardly therefrom with a pad located thereatop, and biasing means urging said piston upwardly within said cylinder.

11. A pit according to claim 10 wherein said biasing means is a coil spring disposed between said cylinder and said pad.

12. A pit according to claim 11 further comprising means for adjusting the elevation of said cylinder relative to said lift assembly, and a pocket formed in an underside of said lid so as to receive said pad therewithin.

13. In an access lid assembly having a lid of rigid construction throughout that is able to withstand the weight applied by the tires of an aircraft traveling thereacross, an annular mounting frame located atop a subsurface chamber used to service aircraft and defining an opening therewithin in which said lid is seatable in a horizontal seated disposition, and the improvement comprising a lift assembly for elevating said lid upwardly from said opening while maintaining it in a horizontal disposition, and a hinge assembly defining a horizontal axis and joining said lid at a peripheral location thereon on an underside thereof to said lift assembly for rotation about said horizontal axis to an open position through an arc of at least ninety degrees.

14. An access lid assembly according to claim 13 further comprising a damper mechanism located on said lift assembly to cushion said lid as it moves from its open position to the horizontal disposition.

15. An access lid assembly according to claim 13 further comprising a vertically oriented shock absorber mounted on said lift assembly in lateral displacement from said horizontal axis to thereby cushion said lid in moving from said open position to the horizontal disposition.

16. An access lid assembly according to claim 15 wherein said shock absorber is adjustable to vary its cushioning effect on said lid.

17. An access lid assembly according to claim 15 wherein said lift assembly includes a shock absorber mounting bracket with a vertically aligned, internally threaded opening therein, and said shock absorber is externally threaded and is screwed into said threaded opening in said mounting bracket to a selected elevation relative thereto, and further comprising a lock nut threadably engaged on said externally threaded shock absorber.

18. An access lid assembly according to claim 17 wherein said shock absorber has a pad on an upper end thereof and said lid has a pocket defined in its underside to receive said pad where said lid is rotated to the horizontal disposition.

19. An access lid assembly according to claim 13 wherein said lid has a resilient, liquid-impermeable, seal disposed thereabout and secured thereto by a dovetail interconnection therebetween.

20. An access lid assembly according to claim 19 wherein said lid has a protective lip extending radially outwardly above said seal to shield said seal from damage from above, and a radially inwardly extending prybar seat located above said protective lip.

* * * * *